US008157348B2

(12) United States Patent
Miramanda et al.

(10) Patent No.: US 8,157,348 B2
(45) Date of Patent: Apr. 17, 2012

(54) PRINT HEAD SERVICING FOR A PAGE WIDE ARRAY PRINTER

(75) Inventors: Silvia Miramanda, Barcelona (ES); Alex Andrea, Barcelona (ES); Angel Martinez, Barcelona (ES); Joan Jorba, Barcelona (ES); Paul Ray, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 308 days.

(21) Appl. No.: 12/243,564

(22) Filed: Oct. 1, 2008

(65) Prior Publication Data

US 2009/0237443 A1 Sep. 24, 2009

Related U.S. Application Data

(60) Provisional application No. 61/038,587, filed on Mar. 21, 2008.

(51) Int. Cl.
*B41J 2/165* (2006.01)

(52) U.S. Cl. ..... 347/22; 347/23; 347/24; 347/33; 347/34; 347/35; 347/42

(58) Field of Classification Search ..... 347/22, 347/23, 24, 29, 30, 32, 33, 42, 81, 104
See application file for complete search history.

(56) References Cited

U.S. PATENT DOCUMENTS

| | | | | |
|---|---|---|---|---|
| 4,853,717 | A | 8/1989 | Harmon et al. | |
| 5,534,897 | A * | 7/1996 | Anderson et al. | 347/32 |
| 5,574,485 | A * | 11/1996 | Anderson et al. | 347/27 |
| 5,838,354 | A * | 11/1998 | Yamada et al. | 347/101 |
| 5,980,018 | A | 11/1999 | Taylor et al. | |
| 6,578,945 | B2 * | 6/2003 | Hashi et al. | 347/22 |
| 6,592,217 | B2 * | 7/2003 | Tanaami | 347/104 |
| 6,652,056 | B2 * | 11/2003 | Shioya | 347/12 |
| 7,229,149 | B2 | 6/2007 | Wotton et al. | |
| 7,252,361 | B2 * | 8/2007 | Nishikawa et al. | 347/22 |
| 2002/0036672 | A1 * | 3/2002 | Courtney et al. | 347/30 |
| 2004/0104961 | A1 * | 6/2004 | Hashi et al. | 347/29 |
| 2004/0246285 | A1 * | 12/2004 | Endo | 347/14 |
| 2005/0073567 | A1 * | 4/2005 | Gil et al. | 347/102 |
| 2007/0200893 | A1 * | 8/2007 | Nakashima | 347/33 |
| 2007/0291291 | A1 * | 12/2007 | Vilar et al. | 358/1.9 |

FOREIGN PATENT DOCUMENTS

EP 1 405 725 * 4/2004

* cited by examiner

*Primary Examiner* — Matthew Luu
*Assistant Examiner* — Justin Seo

(57) ABSTRACT

A page wide array printer comprises a print head bar which carries an array of print nozzles, and which is static during a printing operation. A carriage has print head service elements. The print head bar is movable perpendicularly to the plane of the print medium beneath the print head, between a lowered print position and a raised service position. The carriage is moveable along the print head to perform a service operation when the print head is in the raised position.

18 Claims, 3 Drawing Sheets

PRINT HEAD SERVICING FOR A PAGE WIDE ARRAY PRINTER

CROSS-REFERENCE TO RELATED APPLICATION

This Utility Patent Application is based on and claims the benefit of U.S. Provisional Application No. 61/038,587, filed on Mar. 21, 2008 the contents of which are hereby incorporated by reference in their entirety.

FIELD OF THE INVENTION

This invention relates to the field of printing, and more particularly to the field of print head servicing for a page wide array printer.

BACKGROUND

Examples of the invention relate to a method and apparatus for servicing an inkjet page-wide-array print head.

Inkjet printers eject liquid ink through multiple nozzles to form characters and graphics on a page. Print quality is dependent upon printer resolution and print head performance. Printing at a 300 dpi ("dots per inch") resolution yields print quality comparable to 300 dpi laserjet printing.

To achieve reliable performance, the inkjet print head and inkjet processes are designed to precisely control inkjet output. By controlling the timing, placement and volume of inkjet output droplets, reliable, repeatable character performance and graphic performance is achieved.

A clogged nozzle adversely impacts the placement and volume of inkjet output droplets as the ink droplet may be deflected from its intended destination and less than all ink may escape the nozzle. A seldom used nozzle may get dried ink or contaminants lodged in its orifice. Hot and dry environmental conditions, for example, speed up the drying process and may cause nozzles to clog. Also, contaminants from the external environment or from the printing process may get lodged in a nozzle blocking an orifice. Such clogging may occur despite design efforts to minimize ink drying and maintain a clean print head environment.

Accordingly, there is an ongoing need to provide methods and apparatus for cleaning inkjet print heads.

Conventional inkjet print heads span less than one inch and are scanned across the page. To perform a print operation the print head is moved in one direction while the page is moved in a perpendicular direction. In effect, the print head scans the page while ejecting ink droplets to form the desired printout. When not in use the print head moves into a service area where the print head is cleaned then capped. As the print head moves into a rest position, it traverses an elastomeric wiper (e.g., nitrile rubber). The wiper wipes ink from the print head surface. Scrapers are then used in some embodiments to clean off the wipers.

A page-wide-array ("PWA") print head spans an entire page width (e.g. 8.5 inches) and includes thousands of nozzles. The PWA print head thus has many more nozzles than the scanning-type print heads discussed above. The PWA print head is formed on an elongated printbar. The printbar typically is oriented orthogonally to the paper path. During operation, the printbar and PWA print head are fixed while a page is fed adjacent to the print head. The PWA print head prints one or more lines at a time as the page moves relative to the print head. This compares to the printing of multiple characters at a time as achieved by scanning-type print heads.

Depending on the printout characteristics, certain nozzles on a PWA print head may be exercised less than other nozzles. For example, a user may print most of the time using one inch margins, and on occasion use less than one inch margins. The nozzles in the one inch margin area thus get exercised less regularly, and may clog more readily. This characteristic of uneven nozzle exercise is less common for a scanning-type print head. Scanning print head nozzles that start out in the margin area subsequently move out of the margin area and get exercised as the print head scans the page width.

Thus, certain nozzles on a PWA print head are more prone to clogging than on a scanning-type print head. In general, the problem of drying ink is more pronounced for a PWA print head than for a scanning-type print head. Accordingly, there is a need for an effective cleaning methodology for PWA print heads.

One solution is to remove the printbar and clean the print head in a manner similar to the cleaning of scanning-type print heads. However, to maintain reliable, accurate printing, the printbar is fixed and precisely positioned. There are several mechanical attachments that have to be undone to remove the printbar. Thus, the process would be timely and require careful actions. Also, repeated insertion and removal may wear on the components used for precisely fixing the printbar adding play to the printbar. Thus, it is desirable to use a cleaning methodology for cleaning the print head while in place.

There are various prior solutions for the servicing of a print head which use a dedicated service station, but these typically involve the movement of a print head carriage to the service station. These solutions are not suitable for a PWA printer because they are not suitable for fixed print heads, which do not use a carriage. It is not appropriate to provide movement of the print head bar as a whole to travel to a service location, as this would require the printer footprint to be excessive.

BRIEF DESCRIPTION OF THE DRAWINGS

For an understanding of the invention, embodiments will now be described, purely by way of example, with reference to the accompanying drawings, in which.

DETAILED DESCRIPTION OF THE INVENTION

Examples of the invention relate to the placement of the service station components of a page wide print head in a carriage that moves along the print heads and the media width. In addition, these components can be placed together with the various sensors for analyzing printer performance and the cutter.

Typically, the print heads need maintenance either periodically (with periods of seconds or minutes) or every time a printer starts printing after a stop, in order to keep the nozzles providing good printing conditions. This maintenance or servicing includes:

Spitting of the print heads, in order to remove debris clogging the nozzles, soft viscous plugs and small air bubbles by firing the print heads in reservoirs known as spittoons.

Wiping the print heads, in order to remove debris or excess ink from the orifice plate that could cause ink droplets to deflect from their desired trajectory or even block the nozzles.

A drop detection process, which allows the printer to self-check the status of all the nozzles of all the print heads, detecting whether each particular nozzle is firing correctly, is weak or is missing.

A service schedule is essential to avoid print quality problems. The most common problems are for example banding, line roughness and ink enrichment.

In a Page Wide Array print head configuration with a large print head bar, the printer has a large footprint and the service station is also required to have a large footprint if print head servicing is performed in the traditional way. This traditional servicing comprises the use of a carriage, and the print head travels beyond its normal range to a position on top of the service station.

Figure 1:
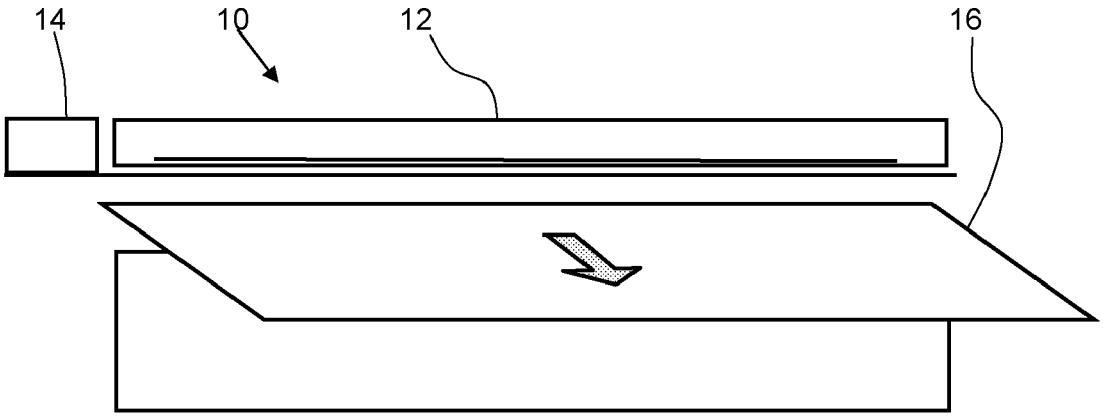
FIG. 1 shows an example of page wide array printer in a first, printing mode.

FIG. 1 shows an example of page wide array printer 10, which comprises a print head bar 12 which carries an array of print nozzles.

A carriage 14 has print head service elements for performing print head servicing.

Figure 2:
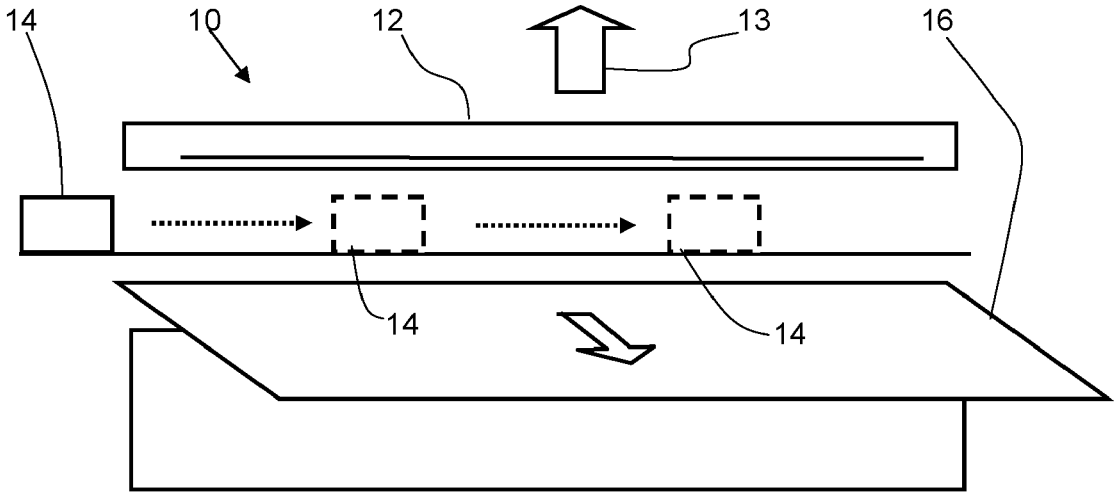
FIG. 2 shows the page wide array printer of FIG. 1 in a second, service mode.

The print head bar 12 is movable between two positions perpendicularly to the print medium (i.e. up and down); a lowered printing position shown in FIG. 1 and a raised servicing position shown in FIG. 2. In the lowered printing position, the print head nozzles are at the desired position with respect to the print medium 16. The print head bar 12 is static during printing, in conventional manner, and includes ink jet print nozzles along its length, which span the full width of the print medium 16 for which the printer is designed. While printing, the service carriage 14 is positioned at one end of the scan axis, next to one end of the print head bar.

The carriage 14 is moveable along the line of print nozzles of the print head, i.e. along the scan axis, when the print head 12 has been raised to the position shown in FIG. 2 (as shown by arrow 13), to perform a service operation.

This service operation comprises the conventional operations of print head spitting, wiping and drop detection of the nozzles. The nozzles serviced at any particular time are those which are in registration with the carriage during its movement, so that the nozzles are serviced in sequence along the scan axis.

In addition, the movable carriage can be used to place different kind of sensors and the cutter. Theses sensors can be the color sensor, the spectrophotometer, the scan sensor, the PPS sensor (pen to paper spacing sensor), and any other sensor for analyzing printed ink on the print medium or paper position.

Whenever the printer finishes, or whenever it otherwise is controlled to implement a service operation, or to cut paper or to use the sensors, the print head bar is lifted up enough to allow the carriage to move underneath.

The required movement of the print head bar is perpendicular to the print medium paper, and therefore does not affect the alignment of the print nozzles with respect to the plane of the print medium. As a result, the mechanical movement of the print head bar does not cause alignment issues of the print nozzles. Furthermore, the overall width is not increased greatly, compared to an arrangement in which the print bar is moved laterally, and high precision mechanisms are not needed.

Lifting the print bar avoids any damage to a print medium, and avoids the need for complicated tensioning arrangements, as the web in the print medium path is not moved.

This arrangement also enables the printer down time for servicing to be minimised.

Figure 3A:
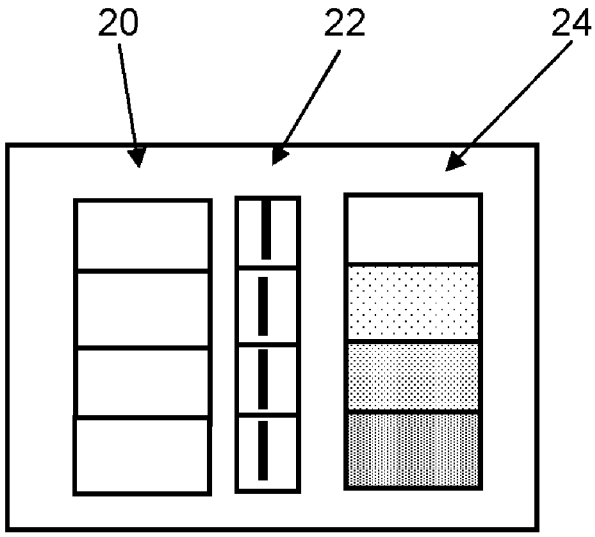
FIG. 3A shows the top surface of the carriage used in the printer of FIGS. 1 and 2.

FIG. 3A shows the elements arranged on the top of the service carriage, which faces the print nozzles during the service operation.

The carriage includes drop detectors 20 (one for each nozzle colour), wipers 22 and spittoons 24. The order of these elements is in the movement direction (spittoons, wipers and drop detectors). There is a line of each element for each color ink (cyan, magenta, yellow, black, gray, blue∟). The example shown assumes four ink colours, simply by way of example.

The service operation thus comprises the following steps:

1. The nozzles spit on the spittoons 24 placed in the carriage;
2. The wipers 22 placed in the carriage clean the print head platen taking advantage of the transversal movement of the carriage 14; and
3. The drop detectors 20 inspect the nozzles that are not firing properly.

Figure 3B:
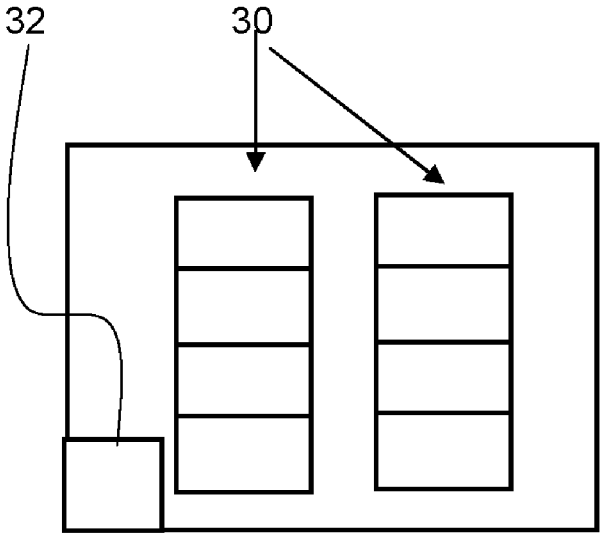
FIG. 3B shows the bottom surface of the carriage used in the printer of FIGS. 1 and 2.

FIG. 3B shows the elements arranged on the bottom of the service carriage, which faces the print medium during the service operation.

Sensors 30 are provided for analysing printed ink on the print medium, or a paper cutter 32.

The sensors placed in this part of the carriage can be used for several objectives such as analyzing printed images/lines in the paper (position, color attributes, distances∟) or also for analyzing the paper position. There are other kinds of sensors such as the Drop Detector or the Optical Media Advance Sensor (OMAS) which are placed in other parts of the printer. The Drop Detector should be below the printheads, and the OMAS below the paper.

The mechanical arrangement of the invention will be routine to those of ordinary skill in the art.

The arrangement above allows print head servicing routines to be implemented for a PWA static print head bar, whilst minimizing printer footprint, as the print head bar does not need to travel to a service station placed at one end of the scan axis. It also allows a carriage to have the dual functions of servicing operations but also print analysis and print medium cutting.

In the example above, the printer is shown as a flat bed printer. However, the system can also be applied to drum printers or web printers using static print heads. In a drum printer, a rotatable drum can be provided with static print bars, which can comprise PWA printheads or pens. Multiple print bars can be provided in sequence around the drum, with each print bar for printing a specific colour. The print medium is held against the rotating print drum for example by means of a vacuum.

Figure 4:
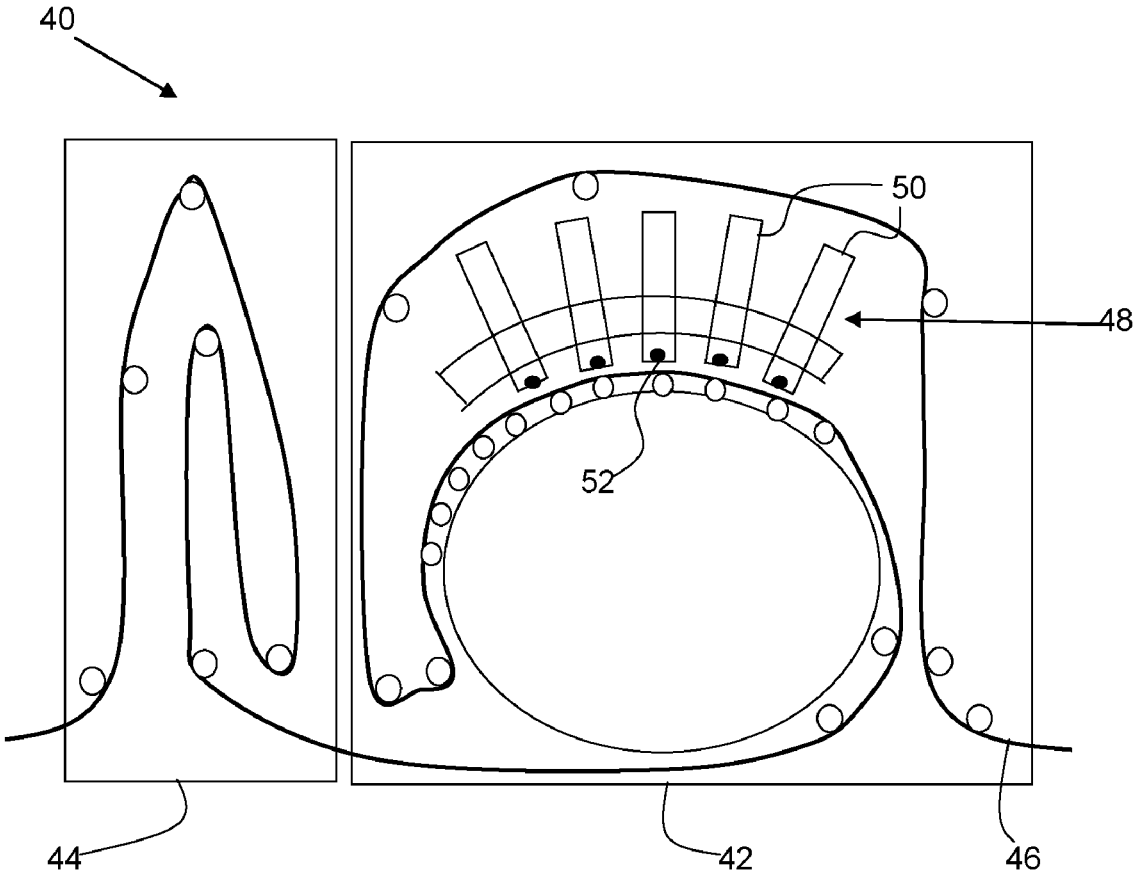
FIG. 4 shows another example of page wide array printer to which the invention can be applied.

FIG. 4 shows in schematic form a web printer 40 which includes a print unit or module 42 and a dryer unit or module 44. The print module 42 selectively deposits printing material upon web 46 to form an image, pattern, layout or arrangement of printing material upon web 46.

The web 46 can comprise a web of printing material such as cellulose-based media, polymeric material or other materials.

The print module 42 includes a printer 48 with print bars 50, comprising ink cartridges and print heads 52. A web flow path is defined across the print bar print heads 52. The print heads 52 can comprise thermal resistive drop-on-demand inkjet print heads or piezo resistive inkjet print heads.

The print bars can each include a self-contained reservoir of fluid which is applied to the associated print heads 52. The different cartridges are typically configured to apply different colors of ink, for example black (K), cyan (C), magenta (M) and yellow (Y) colored inks. A fixer can also be applied to the web 46 prior to application of the colored inks.

The web flow path comprises a path formed by one or more stationary or movable structures along which web 46 is guided and moved. In the particular example illustrated, the web flow path is formed by a series of rollers which guide the print web past the print heads and through the drying unit 44. Stationary structures such as arcuate panels or plates, or pairs of opposing nip rollers may be used to guide or direct web 46 through the apparatus. The arrangement shown is purely schematic, and the detailed design is not material to the instant invention. The drive mechanism for driving the web has not been shown.

FIG. 4 shows a known printer design, to which a mechanism for raising the print bars and a carriage can be applied as described above. Thus, it is clear that the lifting print bar and servicing carriage can be applied to a range of printer designs, including web printers, drum printers, and flat bed printers, and the printers may have one or more PWA print bars. Each PWA print bar can also be made up from multiple print head assemblies, but significantly these are static during normal printing.

While specific embodiments have been described herein for purposes of illustration, various modifications will be apparent to a person skilled in the art and may be made without departing from the scope of the invention. Accordingly, the invention is not limited to the above-described implementations, but instead is defined by the appended claims in light of their full scope of equivalents.

We claim:

1. A page wide array printer, comprising:

a print head bar which carries an array of print nozzles substantially disposed in a line that spans a printable width of a print medium, and which is static during a printing operation; and a carriage comprising print head service elements and spanning less than the printable width, the service elements including a spittoon, a wiper and a drop detector, wherein the print head bar is movable perpendicularly to a plane of the print medium beneath the print head bar, between a lowered print position and a raised service position, wherein the carriage is moveable along the print head bar in a lateral direction along the printable width, perpendicular to the print medium feed direction, to perform a service operation on substantially all of the print nozzles in sequence when the print head bar is in the raised position, and wherein the spittoon, the wiper, and the drop detector are disposed on the carriage such that movement of the carriage along the print head bar in the lateral direction causes an individual print nozzle to be serviced sequentially by the spittoon first, the wiper second, and the drop detector third.

2. A printer as claimed in claim 1, wherein the print head service elements comprise a drop detector.

3. A printer as claimed in claim 1, wherein the print head service elements comprise a wiper.

4. A printer as claimed in claim 1, wherein the carriage comprises a sensor for analyzing the paper position during the service operation.

5. A printer as claimed in claim 1, wherein the carriage comprises a paper cutter.

6. A method of servicing the print head of a page wide array printer, comprising:

moving a print head bar which carries an array of print nozzles that spans an entire printable width of a print medium perpendicularly to a plane of the print medium beneath the print head bar, from a lowered print position to a raised service position, moving a carriage that includes a spittoon sized to receive debris ejected from fewer than all of the nozzles along substantially the entire span of the print head bar to sequentially perform a service operation to the print nozzles, wherein the carriage further includes a wiper and a drop detector, and wherein the carriage movement causes an individual print nozzle to be serviced sequentially by the spittoon first, the wiper second, and the drop detector third.

7. A method as claimed in claim 6, wherein performing a service operation comprises controlling the nozzles to eject ink into the spittoon.

8. A method as claimed in claim 6, wherein performing a service operation comprises wiping the surfaces of the nozzles using the carriage motion to provide relative movement over the nozzle surface.

9. A method as claimed in claim 6, wherein performing a service operation comprises using a drop detector to inspect the nozzles.

10. A printing method for a page wide array printer, comprising:

performing printing using a print head bar which carries an array of print nozzles that spans an entire printable width of a print medium, the print head bar remaining static during printing;

moving the print head bar perpendicularly to a plane of the print medium beneath the print head bar, from a lowered print position to a raised service position, moving a carriage along substantially the entire span of the print head bar in a lateral direction, perpendicular to the print medium feed direction, to sequentially perform a service operation to the print nozzles, wherein each individual print nozzle is sequentially serviced by a spittoon first, a wiper second, and a drop detector third.

11. A method as claimed in claim 10, further comprising cutting the print medium using a cutter mounted on the carriage.

12. A method as claimed in claim 10, further comprising analyzing, during the service operation, printing ink on the print medium or paper position using sensors mounted on the carriage.

13. The printer of claim 1, wherein each of the service elements performs a different type of servicing operation and wherein all of the print nozzles in the line are serviced by a same service element of each individual type.

14. The printer of claim 1, wherein the spittoon, the wiper, and the drop detector are arranged on a surface of the carriage in the lateral direction.

15. The printer of claim 1, wherein some of the service elements are disposed on a first surface of the carriage so as to face the print head bar in the service position, and others of the service elements are disposed on an opposite second surface of the carriage so as to face the print medium in the service position.

16. A printer as claimed in claim 1, wherein the carriage comprises a sensor for analyzing printed ink on the print medium during the service operation.

17. The printer of claim 14, wherein, in the lateral direction, the wiper is disposed between the spittoon and the drop detector.

18. A page wide array printer, comprising:

a print head bar having an array of print nozzles substantially disposed in a line that spans a printable width of a print medium beneath the bar, the bar static during a printing operation; and a carriage spanning less than the printable width and comprising service elements including a spittoon, a wiper, and a drop detector, wherein the bar is movable perpendicularly to a plane of the print medium between a lowered print position and a raised service position, and wherein the carriage is moveable along the line, in a lateral direction perpendicular to a print medium feed direction, to perform a service operation on substantially all of the nozzles in sequence when the bar is in the raised position, wherein the spittoon, the wiper, and the drop detector are disposed on the carriage such that an individual nozzle is serviced sequentially by the spittoon first, the wiper second, and the drop detector third.

* * * * *